US008570269B2

(12) United States Patent
Kim et al.

(10) Patent No.: US 8,570,269 B2
(45) Date of Patent: Oct. 29, 2013

(54) LAMP DRIVING APPARATUS FOR LIQUID CRYSTAL DISPLAY DEVICE HAVING HIGH CONTRAST RATIO

(75) Inventors: Hyeon-Seung Kim, Gyeonggi-Do (KR); Jong-Ho Lim, Daegu (KR)

(73) Assignee: LG Display Co., Ltd., Seoul (KR)

( * ) Notice: Subject to any disclaimer, the term of this patent is extended or adjusted under 35 U.S.C. 154(b) by 684 days.

(21) Appl. No.: 12/003,628

(22) Filed: Dec. 28, 2007

(65) Prior Publication Data

US 2008/0238859 A1 Oct. 2, 2008

(30) Foreign Application Priority Data

Apr. 2, 2007 (KR) ..... 10-2007-0032564

(51) Int. Cl.
*G09G 3/36* (2006.01)

(52) U.S. Cl.
USPC ..... 345/102

(58) Field of Classification Search
USPC ..... 345/87–104
See application file for complete search history.

(56) References Cited

U.S. PATENT DOCUMENTS

| | | | | |
|---|---|---|---|---|
| 2003/0063062 | A1* | 4/2003 | Tsumura et al. | 345/102 |
| 2004/0125071 | A1* | 7/2004 | Kim et al. | 345/102 |
| 2004/0155853 | A1* | 8/2004 | Lin | 345/102 |
| 2005/0242756 | A1 | 11/2005 | Honbo | |
| 2005/0243052 | A1* | 11/2005 | Lim | 345/102 |
| 2005/0264516 | A1* | 12/2005 | Oh et al. | 345/102 |
| 2006/0125772 | A1* | 6/2006 | Takeda | 345/102 |
| 2007/0091059 | A1* | 4/2007 | Kang | 345/102 |
| 2007/0182697 | A1* | 8/2007 | Chang et al. | 345/102 |

FOREIGN PATENT DOCUMENTS

| | | |
|---|---|---|
| CN | 1683971 A | 10/2005 |
| CN | 1702500 A | 11/2005 |
| TW | 1282961 B | 6/2007 |

OTHER PUBLICATIONS

Taiwanese Office Action (Application No. 096150991) dated Jul. 20, 2012, with English translation.

* cited by examiner

*Primary Examiner* — Chanh Nguyen
*Assistant Examiner* — Sanghyuk Park
(74) *Attorney, Agent, or Firm* — Morgan, Lewis & Bockius LLP

(57) ABSTRACT

Disclosed is a technology for implementing a high contrast ratio that cannot be implemented by only an analog dimming or burst dimming method, by selectively turning off lamps on the LCD device, comprising: a control unit outputting control signals and video data for controlling a driving of a gate driving unit and a data driving unit, and brightness control signals; the gate driving unit for supplying scan signals to gate lines on a liquid crystal panel by controlling of the control unit and the data driving unit for supplying a data voltage to data lines; the liquid crystal panel having liquid crystal cells arranged in a matrix type and thin film transistors formed at each intersection between the data lines and the gate lines; a backlight driving unit for controlling an optical amount by controlling a tube current supplied to lamps on a backlight unit and for selectively turning off the lamps when the brightness control signals are inputted; and the backlight unit for implementing a high brightness with respect to a dark area by irradiating a backlight having a brightness corresponding to light from the lamps emitted by the backlight driving unit toward the liquid crystal panel, and turning off some of the lamps.

6 Claims, 6 Drawing Sheets

LAMP DRIVING APPARATUS FOR LIQUID CRYSTAL DISPLAY DEVICE HAVING HIGH CONTRAST RATIO

CROSS-REFERENCE TO RELATED APPLICATION

The present application claims priority under 35 U.S.C. §119 to Korean Patent Application No. 10-2007-0032564 filed on Apr. 2, 2007, which is hereby incorporated by reference in its entirety.

BACKGROUND OF THE INVENTION

1. Field of the Invention

The present invention relates to a backlight driving technology for an LCD (Liquid Crystal Display) device, and more particularly, to a lamp driving apparatus for an LCD device which is capable of implementing a high contrast ratio that cannot be implemented by only an analog dimming method or burst dimming method.

2. Description of the Related Art

As IT (Information Technology) develops recently, a display device plays an important role as a medium for displaying visual information. In order to be spotlighted in the future, the display device has to meet the following conditions such as a low power consumption, a thin thickness, a light weight, a high picture quality and so on.

An LCD device is a typical display device of flat panel display devices and operates to display images by using an optical anisotropy of a liquid crystal. The LCD device has advantages in that it is thin, small, low in power consumption, high in picture quality and so on, accordingly being developed as a main product of the flat panel display devices for replacing a cathode-ray tube (CRT).

Generally, the LCD device serves to display desired images by supplying image information to pixels arranged in a matrix shape, respectively, and adjusting a light transparency of the pixels. Thus, the LCD device includes a liquid crystal panel on which each pixel which is a minimum unit for implementing images is arranged in an active matrix shape, and a driving unit for driving the liquid crystal panel. Further, because the LCD device cannot emit light by itself, the LCD device is provided with a backlight unit for supplying light thereto.

Generally, a contrast ratio (CR) is obtained by dividing a highest brightness value on a screen by a lowest brightness value. Thus, in order to increase the CR, the highest brightness value has to be larger, or the lowest brightness value has to be smaller.

The brightness on the screen for the LCD device is determined by a dimming of the backlight. FIG. 1 shows an analog dimming method in the related art. According to the analog dimming method, the brightness is determined by controlling a tube current (or a tube voltage) supplied to the backlight unit. For example, if the tube current supplied to the backlight unit is maximized, the brightness is maximized. On the contrary, if the tube current is minimized, the brightness is minimized.

The analog dimming method can be simply implemented, but has a narrow dimming range of 100~50%. Also, in a low current state, one of both ends of a lamp to which a power is supplied from an outside has a relatively higher brightness, while the other thereof to which the power is not supplied from the outside has a relatively lower brightness, accordingly the brightness may be ununiformly implemented.

FIG. 2 shows a burst dimming method in the related art. According to the burst dimming method, the brightness is determined as wanted by controlling a duty ratio of the tube current (or the tube voltage) by controlling an input voltage through a pulse width modulation integrated circuit (PWM IC). For example, if the duty ratio of the tube current supplied to the backlight unit is maximized, the brightness is maximized. On the contrary, the duty ratio of the tube current is minimized, the brightness is minimized.

The burst dimming method has advantages in that the dimming range is wide as 100~20% and the brightness can be uniformly implemented at both ends of the lamp.

In some cases, the analog dimming method can be used together with the burst dimming method. That is, the analog dimming method and the burst dimming method can be applied to one backlight unit in some cases.

However, the related LCD device is configured to control the brightness by using one or both of the analog dimming method and the burst dimming method. In such case, it is difficult to increase the contrast ratio due to characteristics of the lamp.

SUMMARY OF THE INVENTION

Therefore, the present invention is directed to implementing a high contrast ratio that cannot be implemented only by an analog dimming method or the burst dimming method, by lowering a lower brightness value by selectively turning off lamps installed on the backlight unit for an LCD device.

To achieve these and other advantages and in accordance with the purpose of the present invention, as embodied and broadly described herein, there is provided a lamp driving apparatus for an LCD device, comprising: a control unit outputting control signals and video data for controlling a driving of a gate driving unit and a data driving unit, and brightness control signals; the gate driving unit for supplying scan signals to gate lines on a liquid crystal panel by controlling of the control unit and the data driving unit for supplying a data voltage to data lines; the liquid crystal panel having liquid crystal cells arranged in a matrix type and thin film transistors formed at each intersection between the data lines and the gate lines; a backlight driving unit for controlling an optical amount by controlling a tube current supplied to lamps on a backlight unit by performing a dimming operation and for selectively turning off the lamps when the brightness control signals are inputted; and the backlight unit for implementing a high brightness with respect to a dark area by irradiating a backlight having a brightness corresponding to light from the plurality of lamps emitted by the backlight driving unit toward the liquid crystal panel, and turning off some of the lamps.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate preferred embodiments of the invention and together with the description serve to explain the principles of the invention.

In the drawings.

DETAILED DESCRIPTION OF THE INVENTION

Description will now be given in detail of the preferred embodiments of the present invention, examples of which are illustrated in the accompanying drawings.

Figure 1:
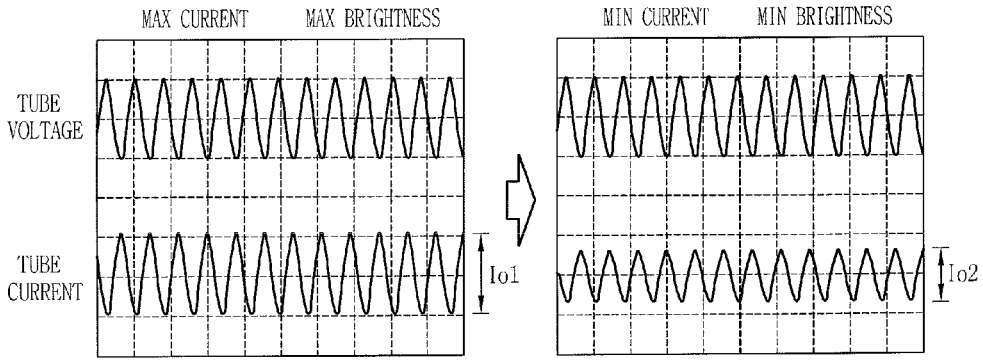
FIG. 1 RELATED ART
FIG. 1 shows an exemplary analog dimming method in the related art.
Figure 2:
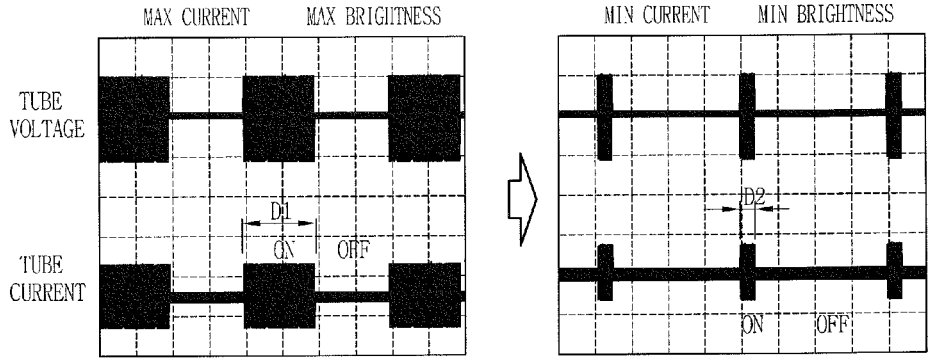
FIG. 2 RELATED ART
FIG. 2 shows an exemplary burst dimming method in the related art.
Figure 3:
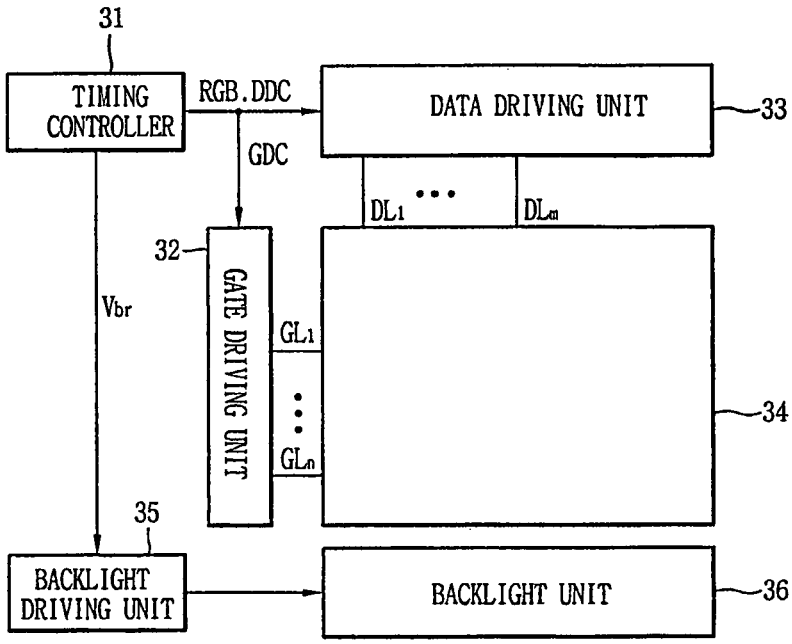
FIG. 3 is a block diagram showing a lamp driving apparatus for an LCD device in accordance with the present invention.

FIG. 3 is a block diagram showing one embodiment of a lamp driving apparatus for an LCD device in accordance with the present invention. As shown, the lamp driving apparatus includes: a timing controller 31 outputting control signals for controlling driving of a gate driving unit 32 and a data driving unit 33, and a digital video data (RGB), and outputting brightness control signals (Vbr); the gate driving unit 32 for supplying scan signals to gate lines (GL1~GLn) on a liquid crystal panel 34 by controlling of the timing controller 31; the data driving unit 33 for supplying a data voltage to data lines (DL1~DLm) on the liquid crystal panel 34 by controlling of the timing controller 31; the liquid crystal panel 34 having liquid crystal cells arranged in a matrix type by the number of m×n and thin film transistors formed at intersections between the m data lines (DL1~DLm) and the n gate lines (GL1~GLn); a backlight driving unit 35 for controlling an optical amount by controlling a tube current supplied to lamps on a backlight unit 36 in a specific dimming method and for selectively turning off the lamps corresponding to the brightness control signals (Vbr) inputted by a specific value; and the backlight unit 36 for implementing a high brightness with respect to a dark area by irradiating a backlight having a brightness corresponding to light from the plurality of lamps emitted by the backlight driving unit 35 toward the liquid crystal panel 34, and turning off some of lamps.

Figure 4:
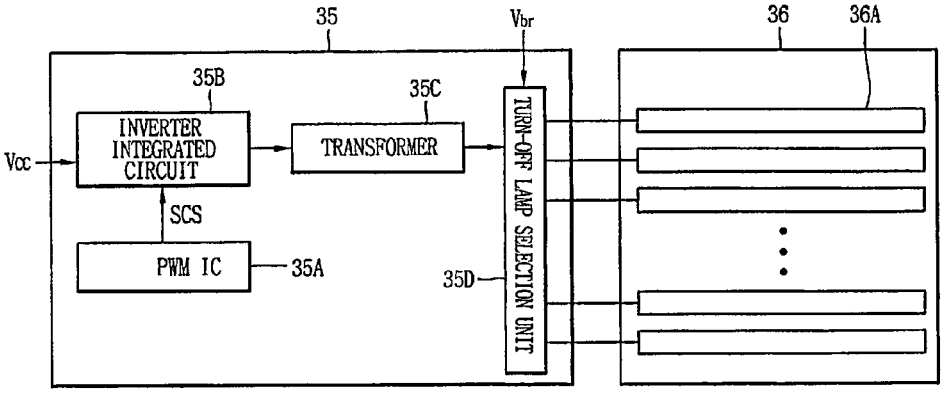
FIG. 4 is a block diagram showing a backlight driving unit in FIG. 3 in detail.

FIG. 4 is a block diagram showing one embodiment of the backlight driving unit 35 in detail. As shown, the backlight driving unit 35 includes a pulse width modulation integrated circuit (PWM IC) 35A outputting switching control signals (SCS) for switching a switching device inside of an inverter integrated circuit 35B by using feedback signals from the backlight unit 35; the inverter integrated circuit 35B converting a power source voltage (Vcc) supplied from a power source into an alternating voltage by using the switching device switched by the switching control signals (SCS) so as to supply the alternating voltage to a transformer 35C; the transformer 35C outputting the alternating voltage outputted from the inverter integrated circuit 35B by converting into a high-pressure alternating voltage corresponding to a winding ratio; and a turn-off lamp selection unit 35D transferring the high-pressure alternating voltage outputted from the transformer 35C to all lamps 36A on the backlight unit 34 normally, but when the brightness control signals (Vbr) are inputted by a specific value, transferring the same selectively so that the high brightness with respect to the dark area is implemented.

An operation of the present invention will be described in detail with reference to FIGS. 5 and 6.

The timing controller 31 outputs the gate control signals (GDC) for controlling the gate driving unit 32, the data control signals (DDC) for controlling the data driving unit 33 and the brightness control signals (Vbr) for controlling the brightness. Further, the timing controller 31 performs sampling of the digital video data (RGB) inputted from the system and then re-aligns the same so as to supply to the data driving unit 33.

The gate driving unit 32 responds to the gate control signals (GDC) from the timing controller 31, and then sequentially supplies a scan pulse (a gate pulse) to the gate lines (GL1~GLn), accordingly horizontal lines on the liquid crystal panel 34 to which the data is supplied are selected.

The data driving unit 33 converts the digital video data (RGB) into a data voltage (an analog gamma compensating voltage) corresponding to a gray scale value by responding to the data control signals (DDC) from the timing controller 31, and then the converted data voltage is supplied to the data lines (DL1~DLm) on the liquid crystal panel 34.

The liquid crystal panel 34 is provided with a plurality of liquid crystal cells disposed at intersections between the data lines (DL1~DLm) and the gate lines (GL1~GLn) in a matrix shape. Thin film transistors (TFT) (not shown) formed at the liquid crystal cells, respectively, respond to the scan signals supplied from the gate lines (GL), and then transfer the data voltage inputted from the data lines (DL1~DLm) to the liquid crystal cells. Further, each liquid crystal cell is provided with a storage capacitor that serves to maintain the voltage of the liquid crystal cell to be constant by being formed between a pixel electrode of the liquid crystal cell and a front end of the gate lines or between the pixel electrode of the liquid crystal cell and a common electrode.

For reference, the gate driving unit 32 and the data driving unit 33 are installed to be separated from the liquid crystal panel 34 in the above description, but currently, they are integrated into a plurality of ICs, and then directly mounted on the liquid crystal panel 34.

The backlight driving unit 35 controls a tube current supplied to the lamp 36A on the backlight unit 36 so that an optical amount irradiated to the liquid crystal panel 34 may be controlled. And, the backlight driving unit 35 selectively turns off the lamps on the backlight unit 36 when the brightness control signals (Vbr) are inputted by a specific value (e.g., 0) from the timing controller 31 so as to implement the high brightness with respect to the dark area. This procedure will be described in detail with reference to FIG. 4.

The pulse width modulation integrated circuit 35A outputs the switching control signals (SCS) for switching the switching device (e.g., MOS transistor) inside of the inverter integrated circuit 35B by using signals fed-back from the lamps 36A on the backlight unit 35.

The inverter integrated circuit 35B converts the power source voltage (Vcc) supplied from the power source into the alternating voltage by using the switching device switched by the switching control signals (SCS) inputted from the pulse width modulation integrated circuit (35A).

The transformer 35C converts the alternating voltage inputted from the inverter integrated circuit 35B into the high-pressure alternating voltage corresponding to the winding ratio, and outputs the converted alternating voltage. That is, the inputted alternating voltage is converted into the high-pressure alternating voltage according to the winding ratio between a first coil and a second coil of the transformer 35C. And then, the converted high-pressure alternating voltage is applied to a high-voltage electrode of the lamps 36A through the turn-off lamp selection unit 35D.

The turn-off lamp selection unit 35D transfers the high-pressure alternating voltage outputted from the transformer 35C at normal times, that is, when the brightness control signals (Vbr) are inputted by another value, not a specific value, to all lamps 36A on the backlight unit 34. Here, the brightness is determined according to the tube current by an analog dimming method or a burst dimming method.

Further, the turn-off lamp selection unit 35D transfers the high-pressure alternating voltage outputted from the transformer 35C when the brightness control signals (Vbr) are inputted by the specific value to some of the lamps 36A, not to all lamps 36A, selectively. In order to selectively supply the high-pressure alternating voltage, it is preferable that the turn-off lamp selection unit 35D is provided with the plurality of switching devices. Here, some of the lamps 36A on the backlight unit 34 to which the high-pressure alternating voltage is not applied, are turned off during corresponding time.

In order to implement the high brightness with respect to the dark area, there may be various methods for selectively turning off the lamps 36A through the turn-off lamp selection unit 35. For example, in order to selectively turn off the lamps, some lamps may be selected per unit number or the lamps in any one of divided areas may be selected.

As an example of the method for turning off some lamps 36A selected per unit number, any one (e.g., odd numbered of the lamps) between odd numbered of lamps and even numbered of lamps may be turned off. Here, the turn-off lamp selection unit 35D switches on the switches connected to the odd numbered of lamps 36A, while switches off the switches connected to the even numbered of lamps.

Figure 5A:
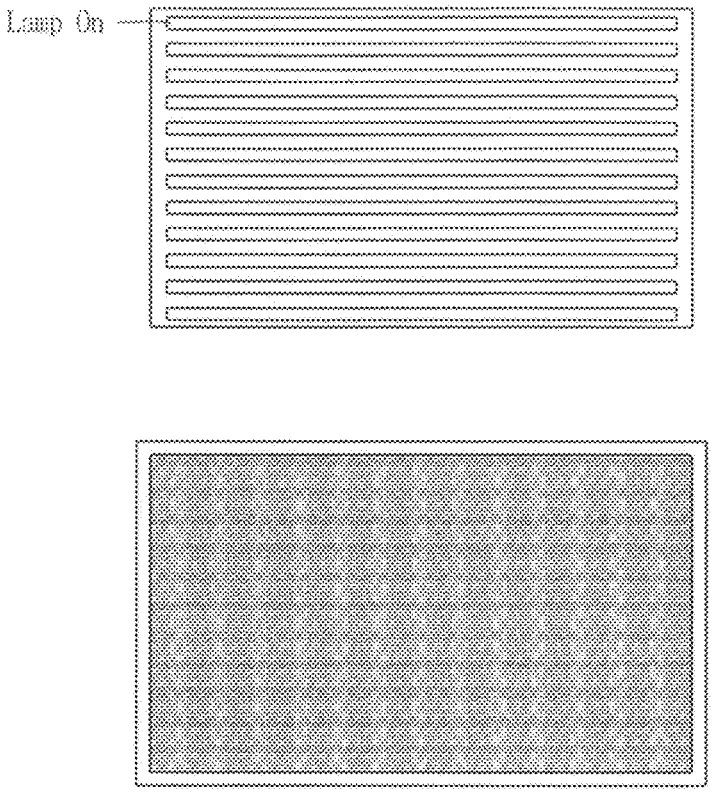
FIGS. 5(*a*) and 5(*b*) are diagrams comparing states of lamps, black patterns and states of screen displaying by implementing a high brightness in accordance with the present invention.
Figure 5B:
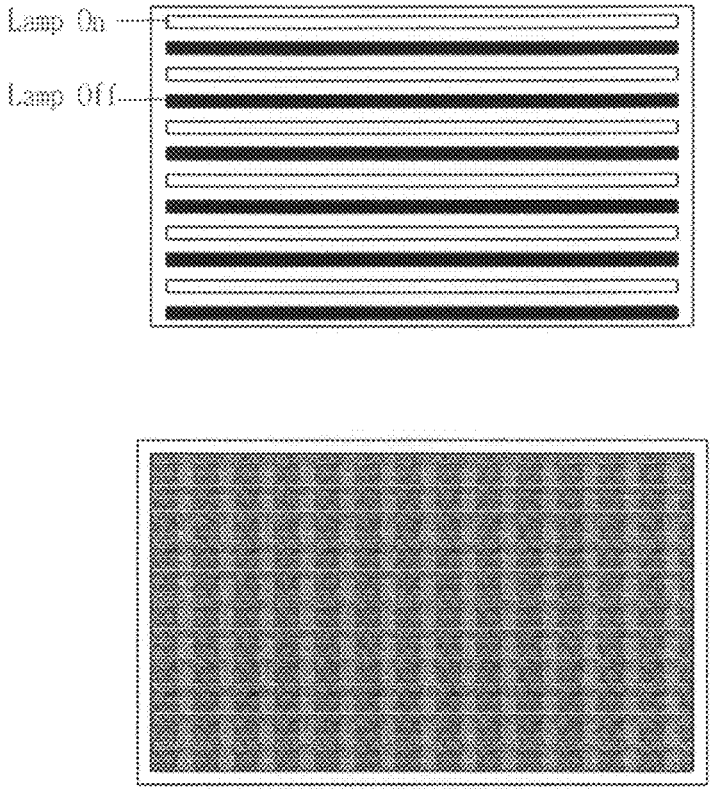

FIGS. 5 (*a*) and 5(*b*) show results of experiments for implementing the high brightness with respect to the dark area by selectively turning off hot cathode fluorescent lamps (HCFLs) applied to the backlight of a 42-inch liquid crystal apparatus.

That is, FIG. 5 (*a*) shows a state of the lamps, a black pattern, and a state of is playing when all of 9 hot cathode fluorescent lamps were turned on by a minimum (Min duty). Here, the brightness was measured as 0.08 nit.

And, FIG. 5 (*b*) shows a state of the lamps, a black pattern, and a state of screen displaying when even numbered of 9 hot cathode fluorescent lamps were turned off, while odd numbered of the hot cathode fluorescent lamps were turned on by the minimum duty ratio. Here, the brightness was measured as 0.05 nit.

Here, the brightness was decreased by 0.03 nit when even numbered of 9 hot cathode fluorescent lamps were turned off, as shown in the results of comparing (a) with (b) of FIG. 5. Thus, the brightness can be higher as much in the dark area.

As another example of the method for turning off some lamps selected per unit number, the lamps 36A are divided by three more units, and then certain numbers of lamps therein are turned off.

As an example of the method for turning off lamps in a corresponding area after dividing the lamps 36A into certain areas, when a night sky is displayed on a half of a screen and a is displayed on another half of the screen, the turn-off lamp selection unit 35 turns on the half of the lamps and turns off the another half of the lamps.

Figure 6:
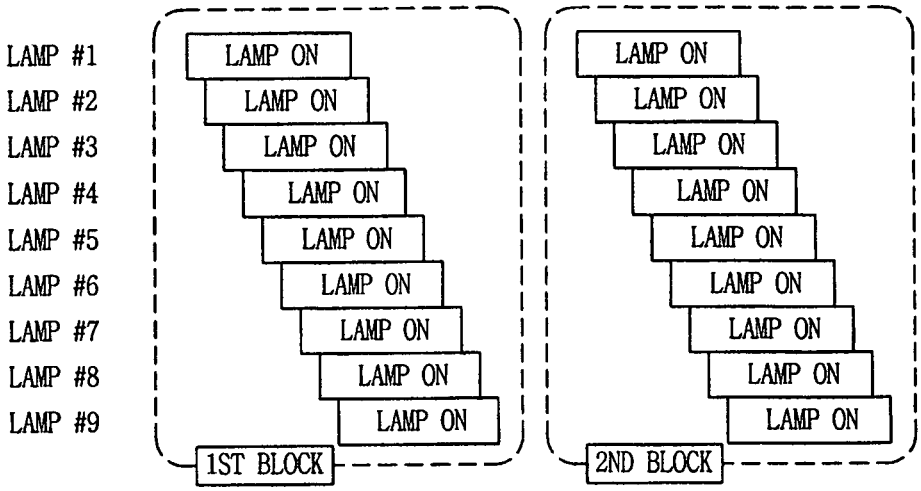
FIG. 6 shows an exemplary scanning lamp driving method in accordance with the present invention.

Generally, a lamp driving method with respect to the backlight for the LCD device can be implemented by a scanning method by which all lamps 36A on the backlight 36 are sequentially turned on, as shown in FIG. 6, and by a non-scanning method by which the lamps 36A are simultaneously turned on. The present invention can be applied by both methods.

For example, in case that the method that all lamps are divided into odd/even numbered lamps and then turned on is applied to the scanning method, the odd numbered of lamps (Lamp #1, Lamp #3, Lamp #5, Lamp #7, Lamp #9) are continuously turned off, while the even numbered of lamps (Lamp #2, Lamp #4, Lamp #6, Lamp #8) are sequentially turned on in the first block. And then, in the second block, the even numbered of lamps (Lamp #2, Lamp #4, Lamp #6, Lamp #8) are continuously turned on, while the odd numbered of lamps (Lamp #1, Lamp #3, Lamp #5, Lamp #7, Lamp #9) are sequentially turned on. The odd and even numbered of lamps are alternately selected in the following blocks, and the selected lamps are sequentially turned on.

Accordingly, it is possible to implement the high brightness in the dark area and to prevent life spans of the lamps from being shortened by turning on only one side between the odd numbered lamps and the even numbered lamps.

As another example, in case that the method that all lamps are divided into odd/even numbered lamps and then turned on is applied to the non-scanning method, the odd numbered lamps (Lamp #1, Lamp #3, Lamp #5, Lamp #7, Lamp #9) are continuously turned off, while the even numbered lamps (Lamp #2, Lamp #4, Lamp #6, Lamp #8) are simultaneously turned on in the first block. And then, in the second block, the even numbered lamps (Lamp #2, Lamp #4, Lamp #6, Lamp #8) are continuously turned on, while the odd numbered of lamps (Lamp #1, Lamp #3, Lamp #5, Lamp #7, Lamp #9) are simultaneously turned on. The odd and even numbered lamps are alternately selected in the following blocks, and then the selected lamps are simultaneously turned on.

Accordingly, it is possible to implement the high brightness in the dark area and to prevent life spans of the lamps from being shortened by turning on only one side between the odd numbered lamps and the even numbered lamps.

As aforementioned, in accordance with the present invention, the lamps installed on the backlight unit for the liquid crystal display device are selectively turned off so that the lower brightness is lowered, accordingly it is possible to implement a high contrast ratio that cannot be implemented by only the analog dimming or the burst dimming method, thereby enhancing the picture quality.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present inventive features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A lamp driving apparatus for an LCD device, comprising:

a control unit configured to output control signals and video data to control a driving of a gate driving unit and a data driving unit, and brightness control signals;

the gate driving unit configured to supply scan signals to gate lines on a liquid crystal panel by controlling the control unit and the data driving unit for supplying a data voltage to data lines;

the liquid crystal panel comprising:

liquid crystal cells arranged in a matrix type; and thin film transistors formed at each intersection between the data lines and the gate lines; and a backlight driving unit configured to:

control an optical amount by controlling a tube current supplied to a plurality of lamps on a backlight unit; and selectively turn off some lamps of the plurality of lamps in response to the brightness control signals being inputted, wherein the backlight unit is configured to implement a lower brightness backlight output in a dark image area by irradiating a backlight comprising a brightness corresponding to light from the lamps emitted by the backlight driving unit toward the liquid crystal panel, and turning off some of the lamps, wherein the backlight driving unit includes:

a pulse width modulation integrated circuit outputting switching control signals for switching a switching device inside of an inverter integrated circuit, the inverter integrated circuit converting a power source voltage supplied from a power source into an alternating voltage by using the switching device switched by the switching control signals to supply the alternating voltage to a transformer, the transformer outputting the alternating voltage outputted from the inverter integrated circuit by converting into a high alternating voltage corresponding to a winding ratio, and a turn-off lamp selection unit configured to:

selectively transfer the high alternating voltage outputted from the transformer to the lamps on the backlight unit, and pass through the outputted high alternating voltage from the transformer to selected lamps, in response to the brightness control signals being inputted, such that the selected lamps can be turned on, and wherein the turn-off lamp selection unit comprises a plurality of switching devices such that all of the lamps are turned on in response to the brightness control signals comprising a non-specific value is inputted and some of the lamps are selectively turned on when the brightness control signals comprising a specific value is inputted.

2. The lamp driving apparatus of claim 1, wherein the turn-off lamp selection unit is provided with a plurality of switching devices to selectively transfer the high alternating voltage.

3. The lamp driving apparatus of claim 1, wherein the backlight driving unit is further configured to turn off the lamps by selecting some lamps per unit number.

4. The lamp driving apparatus of claim 1, wherein the backlight driving unit is further configured to turn off the lamps in a selected area by dividing all the lamps into some areas.

5. The lamp driving apparatus of claim 1, wherein the backlight driving unit is further configured to control a tube current supplied to lamps in an analog dimming method or a burst dimming method.

6. The lamp driving apparatus of claim 1, wherein the backlight driving unit is further configured to drive the lamps in a scanning method or a non-scanning method.

* * * * *